US005823328A

United States Patent [19]

Fomby

[11] Patent Number: 5,823,328

[45] Date of Patent: Oct. 20, 1998

[54] HATBOX WITH A CONCEALABLE STORAGE BOX

[76] Inventor: Kenneth A. Fomby, Rte. 7, Box 435, Gainesville, Tex. 76240

[21] Appl. No.: 915,428

[22] Filed: Aug. 20, 1997

[51] Int. Cl.[6] ..... A45C 11/02; A45C 5/12

[52] U.S. Cl. ..... 206/8; 206/9; 190/13 G

[58] Field of Search ..... 206/8, 9, 278; 190/13 G, 110

[56] References Cited

U.S. PATENT DOCUMENTS

| | | | |
|---|---|---|---|
| 140,548 | 7/1873 | Scott | 190/20 X |
| 306,073 | 10/1884 | Forshay | 206/8 |
| 736,987 | 8/1903 | Manning | 206/8 |
| 798,351 | 8/1905 | La Rock | 190/13 G X |
| 961,418 | 6/1910 | Lloyd | 206/8 |
| 1,520,932 | 12/1924 | Comstock | 190/13 G X |
| 1,577,632 | 3/1926 | Coles | 206/8 |
| 1,606,811 | 11/1926 | Schilke | 206/8 |
| 2,474,458 | 6/1949 | Beaudoin | 206/9 |
| 2,659,481 | 11/1953 | Jones | 206/8 |
| 2,693,275 | 11/1954 | Smith | 206/8 |
| 2,839,217 | 6/1958 | Trudeau | 206/8 X |
| 2,931,488 | 4/1960 | Trudeau | 206/8 |
| 3,438,480 | 4/1969 | Chabrelot | 206/8 |

FOREIGN PATENT DOCUMENTS

| | | | |
|---|---|---|---|
| 19936 | 1/1892 | United Kingdom | 206/8 |

*Primary Examiner*—Sue A. Weaver
*Attorney, Agent, or Firm*—Jenkens & Gilchris

[57] ABSTRACT

A hatbox including sidewalls, a bottom, and a lid, a hat stand secured on the bottom in the hatbox formed by a top and joining sidewalls opening through the bottom of the hatbox defining a storage vault within the hatbox opening through the hatbox bottom, and a storage box having a bottom, sidewalls, and a lid adapted to be latched in place concealed in the storage vault and to be mounted in the hatbox on the hat stand for containing and concealing jewelry and the like when traveling with a hat stored in the hatbox and accessible when the storage box is mounted on the hat stand and the hatbox lid is opened.

10 Claims, 3 Drawing Sheets

HATBOX WITH A CONCEALABLE STORAGE BOX

BACKGROUND OF THE INVENTION

1. Field of the Invention

This invention relates to hatboxes used for the storage of hats both when in temporary residence and when traveling. More particularly, the present invention relates to hatboxes designed particularly for western style hats and including a storage box for jewelry and other small items which is lockable in a concealed vault in the hatbox when traveling and can be mounted in the open hatbox for ready access to the contents when in residence.

2. History of the Prior Art

Many different shapes, sizes, and styles of hatboxes have been used for many generations. Generally, however, such hatboxes have been designed to contain only hats and have had no facilities for the storage and transport of small items, such as jewelry belonging to the user.

SUMMARY OF THE INVENTION

In accordance with the present invention there is provided a new and improved hatbox with a concealable storage box for jewelry and the like which includes a compartment sized and shaped to contain a hat having a bottom, sidewalls, and a lid which opens and closes, a hat stand formed in the compartment on the bottom for supporting a hat stored in the box and defining a vault opening through the bottom of the box, and a concealable storage box which can be releasably locked in the vault in the hat stand for traveling and storage and which can be mounted within the hat compartment on the hat stand for ready access to the contents in the box when a hat is remove d from the hatbox and the hatbox lid is open. The storage box is readily latched in the concealed position in the vault when traveling and is readily latched on the hat stand in the open hatbox when access to the jewelry and other small articles in the storage box is desired.

BRIEF DESCRIPTION OF THE DRAWINGS

The details of a specific embodiment of the invention will be better understood from the following description taken in conjunction with the accompanying drawings wherein.

DETAILED DESCRIPTION OF THE PREFERRED EMBODIMENTS

Figure 3:
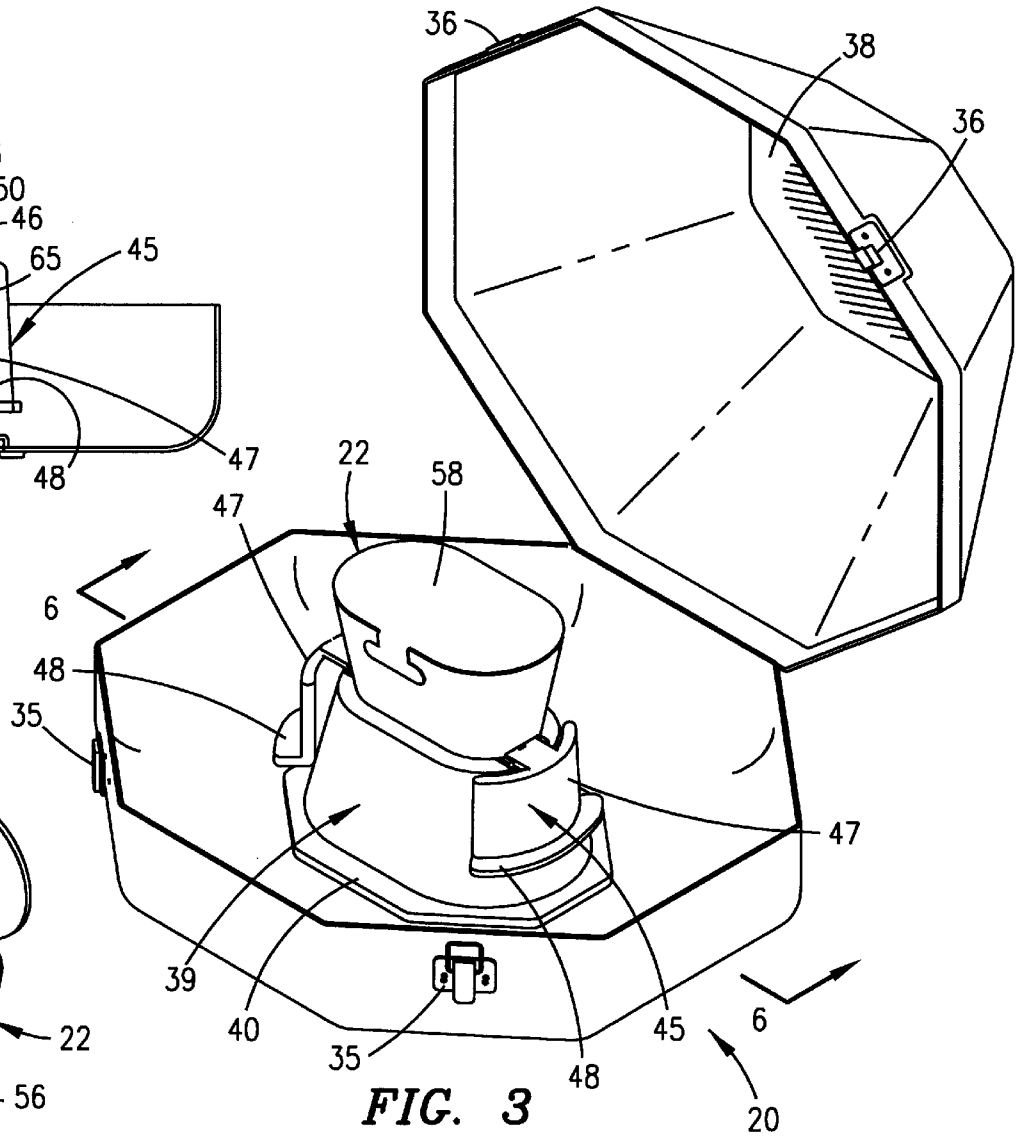
FIG. 3 is a view in perspective of the hatbox with the lid open showing the storage box mounted on the hat stand.
Figure 6:
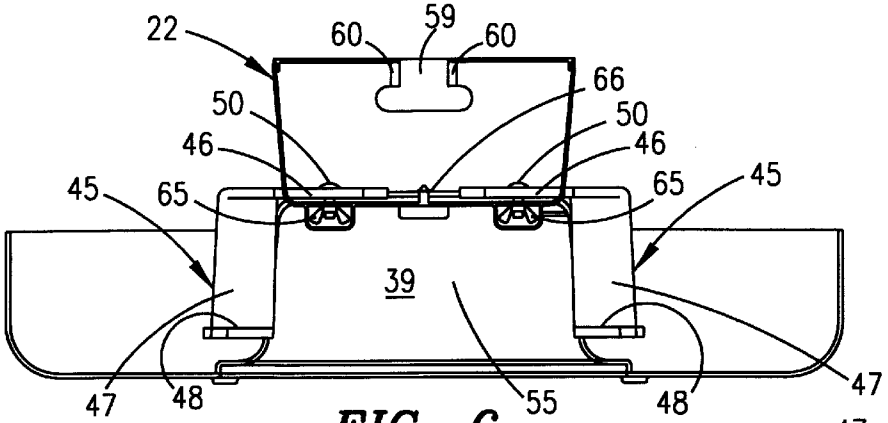
FIG. 6 is a view in section and elevation along the line 6—6 of the FIG. 3.
Figure 7:
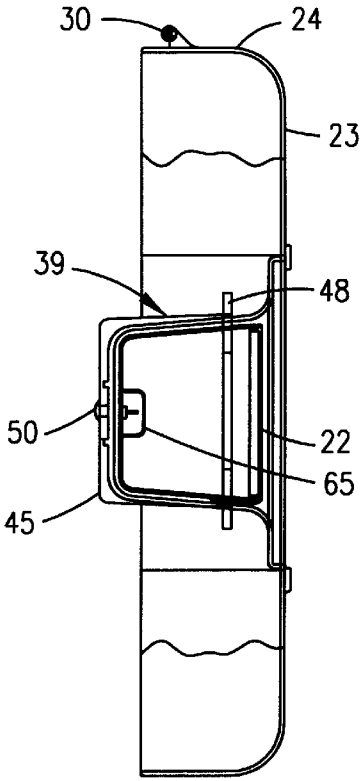
FIG. 7 is an end view of the hatbox with the lid removed as shown in FIG. 9 and broken out to illustrate in section that portion along the line 7—7 of FIG. 9.
Figure 9:
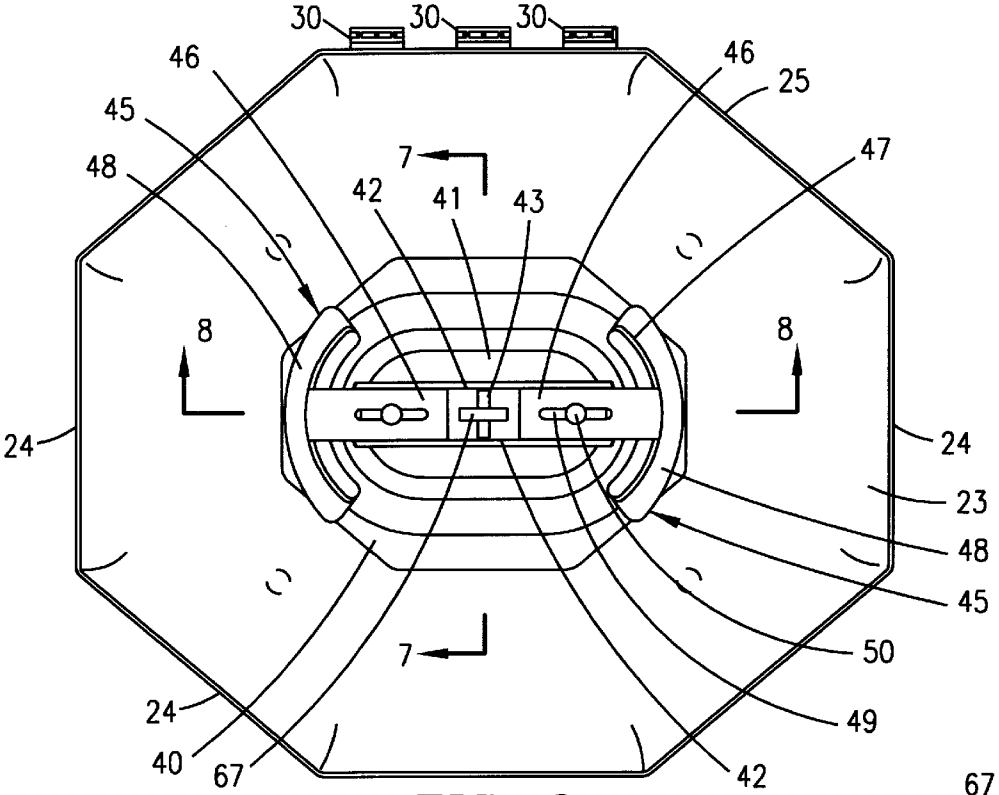
FIG. 9 is a top view of the hatbox with the lid removed showing the hat stand when the storage box is concealed beneath the hat stand.
Figure 8:
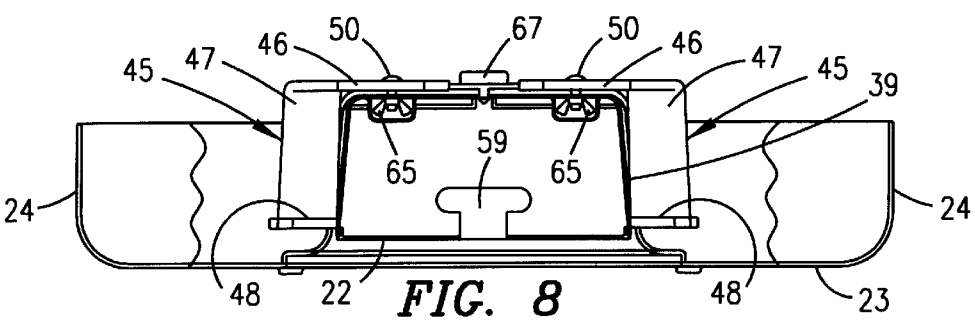
FIG. 8 is a view in section and elevation of the hatbox with the lid removed as illustrated in FIG. 9 with a portion broken out in section along the line 8—8 of FIG. 9.

Referring to the drawings, a hatbox assembly 20 embodying the features of the invention includes a hatbox 21 and a storage box 22 which may be latched in a concealed position for storage and traveling shown in FIGS. 7–9 and in a position for ready access to the contents of the storage box by the user illustrated in FIGS. 3 and 6.

Figures 1, 2:
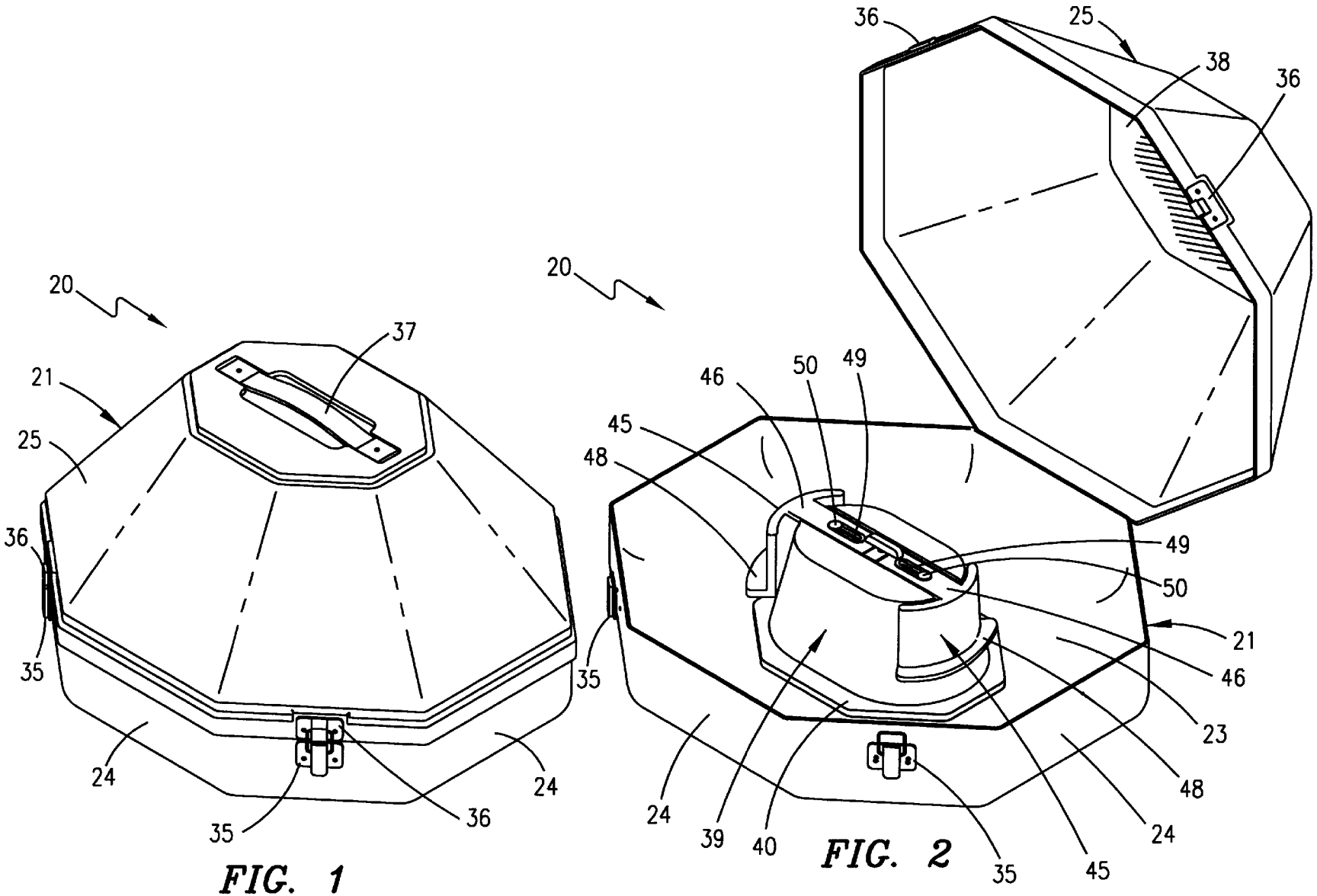
FIG. 1 is a view in perspective of a hatbox in accordance with the invention showing the lid closed.
FIG. 2 is a view in perspective similar to FIG. 1 showing the lid of the hatbox open revealing the hat stand within the hatbox.

The hatbox 21 includes a bottom 23 with connecting sidewalls 24 and a lid 25 secured with one of the sidewalls by hinges 30 illustrated in FIGS. 7 and 9. The lid 25 is held closed as shown in FIG. 1 by buckles 35 on the sidewalls 24 which coact with latches 36 Counted on the lid. A handle 37 is secured on the lid 25 of the hatbox for carrying the hatbox and opening and closing the lid. A mirror 38 is mounted in the lid for use when the lid is open as in FIG. 3.

Referring particularly to FIG. 3, a hat stand 39 including a base 40 is mounted on the hatbox bottom 23. Referring particularly to FIG. 9, the hat stand 39 has a top 41 provided with longitudinal parallel spaced apart guide flanges 42 and a central transverse slot 43 the functions of which are described hereinafter. Adjustable hat support brackets 45 are secured on the hat stand. Each of the hat support bracket s has a mounting strip 46, an arc shaped crown piece 47, and a brim support flange 48. The two crown pieces fit within the crown of a hat, not shown, while the brim flanges 48 engage the hat brim at the juncture of the brim with the hat crown for supporting the hat within the hatbox off the bottom of the hatbox. Each of the support bracket mounting strips 46 has a longitudinal slot 49 sized to receive the bolt of a nut and bolt assembly 50, FIG. 6, connecting the two hat support brackets to the top of the hat stand. The slot 49 in each of the mounting strips 46 permits the brackets 45 to be adjusted longitudinally by moving the brackets together and apart to adjust them to the inside dimensions of a hat crown for use with various size hats.

Figure 4:
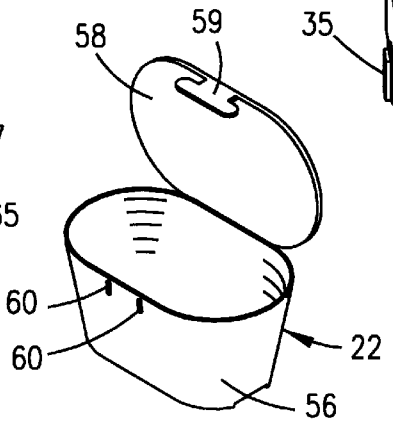
FIG. 4 is a view in perspective of the storage box with the lid open.
Figure 5:
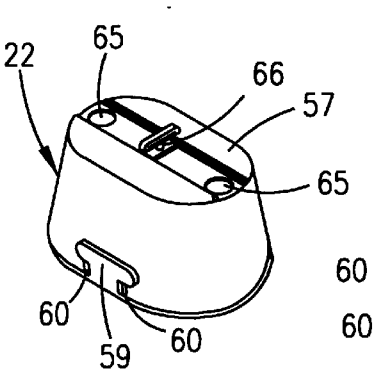
FIG. 5 is a view in perspective of the storage box showing the bottom of the box and the latch used to releasably lock the box in both the concealed mode and the accessible mode on the hat stand of FIG. 3.

In accordance with a particular feature of the invention, the storage box 22 is provided to contain jewelry, bolo ties, and other small accessory items of the user of the hatbox. As previously mentioned, the storage box is concealed for traveling and the like as illustrated FIGS. 2, and 7–9, and the storage box is also mounted as desired for ready access on the hat stand 39 as represented in FIGS. 3 and 6. The interior of the hat stand 39 defines a vault 55 opening through the bottom 23 of the hatbox for concealing the storage box. The vault 55 as shown in FIGS. 6 and 8 is sized and shaped to receive the storage box 22. Referring particularly to FIGS. 4 and 5, the storage box 22 is formed of a continuous oval shaped sidewall 56, a bottom 57, FIG. 5, and a hinged lid 58. The lid 58 has a T-shaped latch flap 59 which snaps between spaced latch flanges 60 on the box sidewall to hold the lid closed as illustrated in FIGS. 3 and 5. The bottom 57 of the storage box 22 includes spaced cylindrical sockets, FIGS. 5 and 6, which are sized, shaped, and spaced apart to receive the nut portions of the nutbolt assemblies 50 when the storage box is in the concealed position in the vault 55 of the hatbox as represented in FIG. 8. The storage box bottom 57 is also provided with a centrally located hole 66 for use in attaching the storage box 22 to the hat stand 39 in both the concealed mode of FIGS. 7–9 and the accessible mode of FIGS. 3 and 6.

Figure 10:
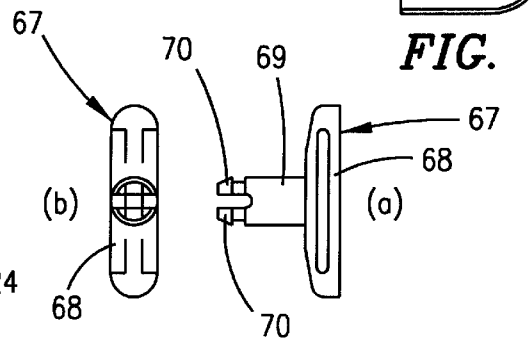
FIGS. 10*a* and 10*b* are enlarged side and end views of the latch used for holding the storage box in the concealed position in FIGS. 7–9 and in the position for access into the storage box illustrated in FIGS. 3 and 6.

Referring to FIGS. 10(*a*) and 10(*b*), a storage box latch 67 has a transverse handle or head 68 on a shank 69 provided with spaced, endwardly extending, latch fingers 70. The shape, size, and spacing of the fingers 70 in relation to the diameter of the hole 66 in the bottom of the storage box 22 are designed so that the latch 67 will releasably lock with the bottom of the storage box at both positions of the storage box, concealed as in FIGS. 7–9, and accessible to the user as in FIGS. 3 and 6.

The hatbox of the invention is prepared for traveling by first placing jewelry and the other desired small items in the open storage box 22 as illustrated in FIG. 4. The lid 58 is then closed and locked by placing the latch flap 59 between the latch flanges 60 which holds the lid closed. The storage box is then inverted to the position of FIG. 5. Prior to storing articles in the storage box, the latch 67 is removed from the position in the bottom of the storage box shown in FIG. 5 so that the storage box may rest on a table or the like. With the storage box loaded and the lid latch closed, the storage box is turned over to the position of FIG. 5 and then inserted through the bottom 23 of the hatbox into the vault 55 to the position illustrated in FIGS. 7 and 8. The sockets 65 in the storage box bottom are aligned with the nuts on the nut-bolt assemblies 50 so that the nuts fit within the sockets 65 as shown in FIG. 8. At this position of the storage box, the hole 66 in the storage box bottom is in registry with the transverse slot 43 in the hat stand. The storage box is then locked in place in the vault with the latch 67 as shown in FIG. 8. The shank 69 of the latch is inserted downwardly through the slot 43 into the hole 66 in the storage box until the latch fingers 70 snap into place in the hole. The latch handle 68 is turned to a longitudinal position perpendicular to the slot 43 as shown in FIGS. 8 and 9. At this position of the latch 67, the storage box is held concealed in the vault 55 beneath the hat stand. With the brackets 45 on the hat stand adjusted to the size of a desired hat, not shown, the hat is then placed on the hat stand brackets with the hat stand and brackets fitting up into the crown of the hat and the brim of the hat resting on the flanges 48. The hatbox lid 25 is then closed and locked with the buckles 35 engaging the latches 36.

When the user of the hatbox 20 arrives at a destination such as a hotel where the hat stored in the hatbox is to be used and the jewelry and other items in the storage box are needed, the hatbox is placed on a suitable surface such as a table, the hatbox is unlocked by releasing the buckles 35 from the latches 36 and the lid 25 of the hatbox is opened to the position of FIG. 2. The hat is removed from the hat stand. The latch 67, which is in the locked position of FIGS. 2, 8, and 9, is rotated 90 degrees aligning the latch handle 68 with the slot 43 in the hat stand top releasing the storage box from the latched position in the vault. The storage box may then be dropped from the vault in the inverted position illustrated in FIG. 5. With the latch 67 remaining in the position shown in FIG. 5, perpendicular to the longitudinal axis of the storage box, the storage box is turned to the upright position of FIGS. 3 and 6. The storage box bottom is placed on the top of the hat stand inserting the handle 68 of the latch 67 through the slot 43 allowing the storage box to rest on the hat stand in the position shown in FIGS. 3 and 6. The latch 67 is then rotated back to the position perpendicular to the slot 43 illustrated in FIG. 6 to lock the storage box on the hat stand as shown in FIGS. 3 and 6. The storage box latch flap 59 may then be released from the latch flanges 60 to open the storage box to the open position of FIG. 4 so that the jewelry and other items in the storage box may be removed.

It will be recognized that a new and improved hatbox with a concealable storage box for jewelry and the like has been described and illustrated. The hatbox provides for very convenient transport of the small items along with a hat and ready availability of items in the storage box when needed.

What is claimed is:

1. A hatbox in with a concealable storage box comprising:

a receptacle having a bottom, side walls, and a lid adapted to open and close defining a hat compartment;

a hat stand secured in the hat compartment on the bottom thereof including an enclosure wall and top for supporting a hat spaced from the bottom of the compartment, the interior of the hat stand defining a storage vault opening through the bottom of the compartment; and a storage box having side walls, a bottom, and a lid; and latch structure for securing the storage box at a first concealed mode in the storage vault and in a second mode on the hat stand in the hat compartment with the bottom of the storage box secured with the hat stand for holding the box in place and permitting access into the box.

2. A hatbox with a concealable storage box in accordance with claim 1 where the latch structure comprises:

a latch socket in the bottom of the storage box;

a latch socket in the hat stand top; and a latch having a shank with latch fingers sized to extend from the hat compartment through the socket in the hat stand into the socket in the storage box to hold the storage box in the first concealed mode in the vault and to extend from the vault through the socket in the hat stand into the socket in the storage box to hold the storage box in the second mode on the hat stand in the hat compartment.

3. A hatbox with a concealable storage box in accordance with claim 2 where the latch comprises a shank with locking fingers formed integral with a wing portion for engaging and disengaging the latch.

4. A hatbox with a concealable storage box in accordance with claim 3 where the storage box has a latch flap on one of the side walls and the lid, and latch flanges on the other of the sidewalls and the lid, the latch flap engaging the latch flanges to releasably lock the lid closed.

5. A hatbox with a cancealable storage box in accordance with claim 4 where the hat stand includes adjustable brackets movable in opposite longitudinal directions on the hat stand to conform to the inside dimensions of a hat stored on the stand in the hat compartment.

6. A hatbox with a concealable storage box in accordance with claim 5 wherein the adjustable brackets each has an arc shaped portion to conform to the internal shape of a hat crown and at integral slidable mounting strip having an elongated slot for a bolt for slidably securing each of the brackets on the enclosure top to permit the brackets to move together and apart to conform the brackets to the crown size of a hat.

7. A hatbox with a concealable storage box in accordance with claim 6 where the brackets each has an integral support flange along the arc shaped portion for engaging the brim of a hat stored on the brackets.

8. A hatbox with a concealable storage box in accordance with claim 7 wherein the hatbox lid is hinged to a sidewall and buckle assemblies are mounted on the lid and sidewall to lock the lid closed.

9. A hatbox with a concealable storage box in accordance with claim 8 wherein the hatbox, hat stand, and storage box are each formed of molded plastic.

10. A hatbox with a concealable storage box comprising:

a hatbox having a bottom, sidewalls, a hinged lid, and buckle assemblies for releasably locking the lid closed;

a hollow hat stand in the hatbox secured with the bottom of the hatbox including longitudinally adjustable hat support brackets mounted on the hat stand, the interior of the hat stand forming a storage vault opening through the bottom of the hatbox;

a storage box having sidewalls, a bottom, and a hinged lid sized and shaped to fit within the vault in the hat stand; and latch means in the top of the hat stand and in the bottom of the storage box for releasably locking the storage box at a first concealed position within the vault and at a second accessible position on the top of the hat stand at which the bottom of the storage box is releasably latched to the top of the hat stand.

* * * * *